US010316570B2

(12) United States Patent
Muramatsu et al.

(10) Patent No.: US 10,316,570 B2
(45) Date of Patent: Jun. 11, 2019

(54) WINDOW REGULATOR FOR VEHICLE

(71) Applicant: SHIROKI CORPORATION, Fujisawa-shi, Kanagawa (JP)

(72) Inventors: Atsushi Muramatsu, Fujisawa (JP); Kenji Yamamoto, Fujisawa (JP)

(73) Assignee: SHIROKI CORPORATION, Fujisawa-shi, Kanagawa (JP)

( * ) Notice: Subject to any disclaimer, the term of this patent is extended or adjusted under 35 U.S.C. 154(b) by 0 days.

(21) Appl. No.: 15/554,758

(22) PCT Filed: May 27, 2016

(86) PCT No.: PCT/JP2016/065668
§ 371 (c)(1),
(2) Date: Aug. 31, 2017

(87) PCT Pub. No.: WO2016/194793
PCT Pub. Date: Dec. 8, 2016

(65) Prior Publication Data

US 2018/0044968 A1 Feb. 15, 2018

(30) Foreign Application Priority Data

May 29, 2015 (JP) ..... 2015-109400

(51) Int. Cl.
*E05F 15/689* (2015.01)
*E05F 11/48* (2006.01)

(52) U.S. Cl.
CPC ..... *E05F 15/689* (2015.01); *E05F 11/48* (2013.01); *E05F 11/483* (2013.01);
(Continued)

(58) Field of Classification Search
CPC ..... E05F 15/689; E05F 11/481; E05F 11/488; E05D 15/165
See application file for complete search history.

(56) References Cited

U.S. PATENT DOCUMENTS 4,235,046 A * 11/1980 Hess ..... E05F 11/485 49/352
5,033,233 A * 7/1991 Suzumura ..... E05F 11/486 49/352

(Continued)

FOREIGN PATENT DOCUMENTS

JP 2613483 B2 5/1997
JP 2919770 B2 4/1999

(Continued)

OTHER PUBLICATIONS

International Search Report (PCT/ISA/210) dated Aug. 23, 2016, by the Japanese Patent Office as the International Searching Authority for International Application No. PCT/JP2016/065668.

(Continued)

*Primary Examiner* — Catherine A Kelly
(74) *Attorney, Agent, or Firm* — Buchanan Ingersoll & Rooney PC

(57) ABSTRACT

A vehicle window regulator includes a slider base supported on a guide rail; a drive wire connected to the slider base; a wire guide supported at one end of the guide rail and having a winding part, onto which the drive wire is wound, at a position offset from the guide rail in a vehicle width direction; and a driver which raises and lowers the slider base via the drive wire. The wire guide is supported by the guide rail by a retainer and a pressing portion, the retainer engaged with the guide rail, and the pressing portion being engaged with the guide rail to press the guide rail toward the other end of the guide rail. The pressing portion is formed at a position toward the other end and formed at a position offset from the retainer toward the winding part.

6 Claims, 13 Drawing Sheets

(52) U.S. Cl.
CPC ..... *E05Y 2201/654* (2013.01); *E05Y 2201/66* (2013.01); *E05Y 2201/662* (2013.01); *E05Y 2201/668* (2013.01); *E05Y 2201/708* (2013.01); *E05Y 2600/63* (2013.01); *E05Y 2800/404* (2013.01); *E05Y 2800/406* (2013.01); *E05Y 2800/682* (2013.01); *E05Y 2900/55* (2013.01)

(56) References Cited

U.S. PATENT DOCUMENTS

| | | | | |
|---|---|---|---|---|
| 8,402,694 | B2 * | 3/2013 | Daumal Castellon | E05F 11/481 49/348 |
| 9,255,433 | B2 * | 2/2016 | Imaoka | E05F 11/486 |
| 9,677,312 | B2 * | 6/2017 | Marsh | E05F 11/48 |
| 9,771,746 | B2 * | 9/2017 | Costigan | B60J 1/17 |
| 9,896,874 | B2 * | 2/2018 | Chono | B60J 1/17 |
| 10,017,979 | B2 * | 7/2018 | Ando | E05F 11/483 |
| 10,030,430 | B2 * | 7/2018 | Muramatsu | E05F 11/483 |
| 2004/0237699 | A1 * | 12/2004 | Kinoshita | E05F 11/488 74/502.6 |
| 2009/0094895 | A1 * | 4/2009 | Park | E05F 11/382 49/28 |
| 2009/0188167 | A1 * | 7/2009 | Maruyama | E05F 11/483 49/347 |
| 2012/0297682 | A1 * | 11/2012 | Ha | E05F 11/486 49/358 |
| 2015/0275560 | A1 | 10/2015 | Yamamoto et al. | |
| 2017/0314307 | A1 * | 11/2017 | Imaoka | E05F 11/48 |

FOREIGN PATENT DOCUMENTS

| | | | |
|---|---|---|---|
| JP | 2001-182428 | A | 7/2001 |
| JP | 2012-246671 | A | 12/2012 |
| JP | 2014-177838 | A | 9/2014 |
| WO | 2014069199 | A1 | 8/2014 |

OTHER PUBLICATIONS

Written Opinion (PCT/ISA/237) dated Aug. 23, 2016, by the Japanese Patent Office as the International Searching Authority for International Application No. PCT/JP2016/065668.

European Search Report dated Dec. 14, 2018 for corresponding EPO Application No. 16803228.2 (7 pages).

* cited by examiner

WINDOW REGULATOR FOR VEHICLE

TECHNICAL FIELD

The present invention relates to a window regulator configured to raise and lower a window glass of a vehicle.

BACKGROUND ART

A regulator is known in the art having a guide rail extending in an upward and downward direction; a slider base supported on the guide rail in a manner to be raisable and lowerable therealong, a window glass being mounted onto the slider base; a pair of drive wires that extend upwardly and downwardly from the slider base; a pair of upper and lower wire-guide members configured to guide the pair of drive wires; and a driver (drive motor) configured to drive the pair of drive wires, which are guided by the upper and lower wire-guide members (Patent Literature 1).

In such a type of window regulator, at least one of the upper and lower wire-guide members is supported by the guide rail, and this guide rail, due to space problems within the door, is mounted to a door panel (inner door panel) via mounting brackets (panel mounts) at positions (at inner positions from respective wire guide members along the extending direction of the guide rail) away from upper and lower end-portions of the guide rail (the upper and lower end-portions of the guide rail cannot be mounted onto the door panel).

CITATION LIST

Patent Literature

[Patent Literature 1] Japanese Unexamined Patent Publication No. 2012-246671

SUMMARY OF INVENTION

Technical Problem

Due to the demand for lighter-weight vehicles, there is also a demand for lighter-weight window regulators. Reducing the thickness of the metal sheet that configures the guide rail has been studied as one idea for achieving a lighter weight. However, if the thickness of the guide rail is reduced, a new problem occurs with the guide rail deforming.

In other words, due to the raising and lowering of the window glass, tension is applied to the end-portions of the guide rail via the drive wires and the wide-guide members. On the other hand, since the mounting positions of the guide rail onto the door panel are at inner positions from respective wire guide members along the extending direction of the guide rail (for example, a downward position from upper wire-guide member in the case of the upper wire-guide member), there is a possibility of the guide rail deforming upwardly and downwardly from the door panel mounting position. This deformation occurs in the vehicle width direction about the door panel mounting position(s), and is tentatively termed as "bowing deformation". In addition to thickness reduction, in order to arrange the wire-guide members and the drive wires, the end portions of the guide rail are cut out, thereby changing the sectional shape of the guide rail (reducing the section coefficients), an increase in the torque of the drive motor also becomes a cause of "bowing deformation".

Accordingly, it is an object of the present invention to achieve a window regulator in which "bowing deformation" of the guide rail does not easily occur even if a reduction in thickness of the guide rail or a change in profile of the cross-section thereof occurs.

Solution to Problem

The present invention a window regulator is provided, including a guide rail extending in an upward and downward direction; a slider base supported on the guide rail in a manner to be raisable and lowerable therealong, a window glass being mounted onto the slider base; a drive wire connected to the slider base; a wire guide supported at one end portion of the guide rail, the wire guide having a winding part, onto which the drive wire is wound at a position offset from the guide rail in a vehicle width direction; and a driver configured to raise and lower the slider base via the drive wire. The wire guide is supported by the guide rail by at least a retainer and a pressing portion, the retainer being engaged with the guide rail to prevent the wire guide from moving away from the guide rail in the vehicle width direction, and the pressing portion being engaged with the guide rail so as to press the guide rail toward the other end of the guide rail. The pressing portion is formed at a position toward the other end relative to the retainer, and formed at a position that is offset from the retainer in a vehicle width direction toward the winding part.

In an embodiment, the pressing portion is positioned on a plane of movement in which the drive wire, which moves in accordance with the wire guide, or the pressing portion is positioned from the plane away from the retainer.

It is desirable for the pressing portion to overlap with part of a panel mount, with respect to the upward and downward direction, when viewed in a vehicle forward and rearward direction, the panel mount configured to mount the guide rail to a door panel.

In an embodiment, the wire guide includes a pulley bracket; and a pulley, onto which the drive wire is wound, the pulley being rotatably supported by the pulley bracket. The retainer includes a pulley axle which supports the pulley and the pulley bracket onto the guide rail. The pressing portion is formed on the pulley bracket.

It is desirable for the pressing portion to be connected to the pulley bracket, wherein the pulley bracket is positioned to sandwich the pulley, in the vehicle width direction, by the retainer, the pulley bracket includes a pulley-axle supporter with which the pulley axle engages, and the pulley axle presses the pulley-axle supporter toward the other end.

It is practical for one of the pressing portions to be a projection and for the other of the pressing portions to be a hole, into which said projection engages.

Advantageous Effects of Invention

According to the present invention, a window regulator can be achieved in which "bowing deformation" of the guide rail does not easily occur even if a reduction in thickness of the guide rail or a change in profile of the cross-section thereof occurs.

DESCRIPTION OF EMBODIMENTS

Figure 1:
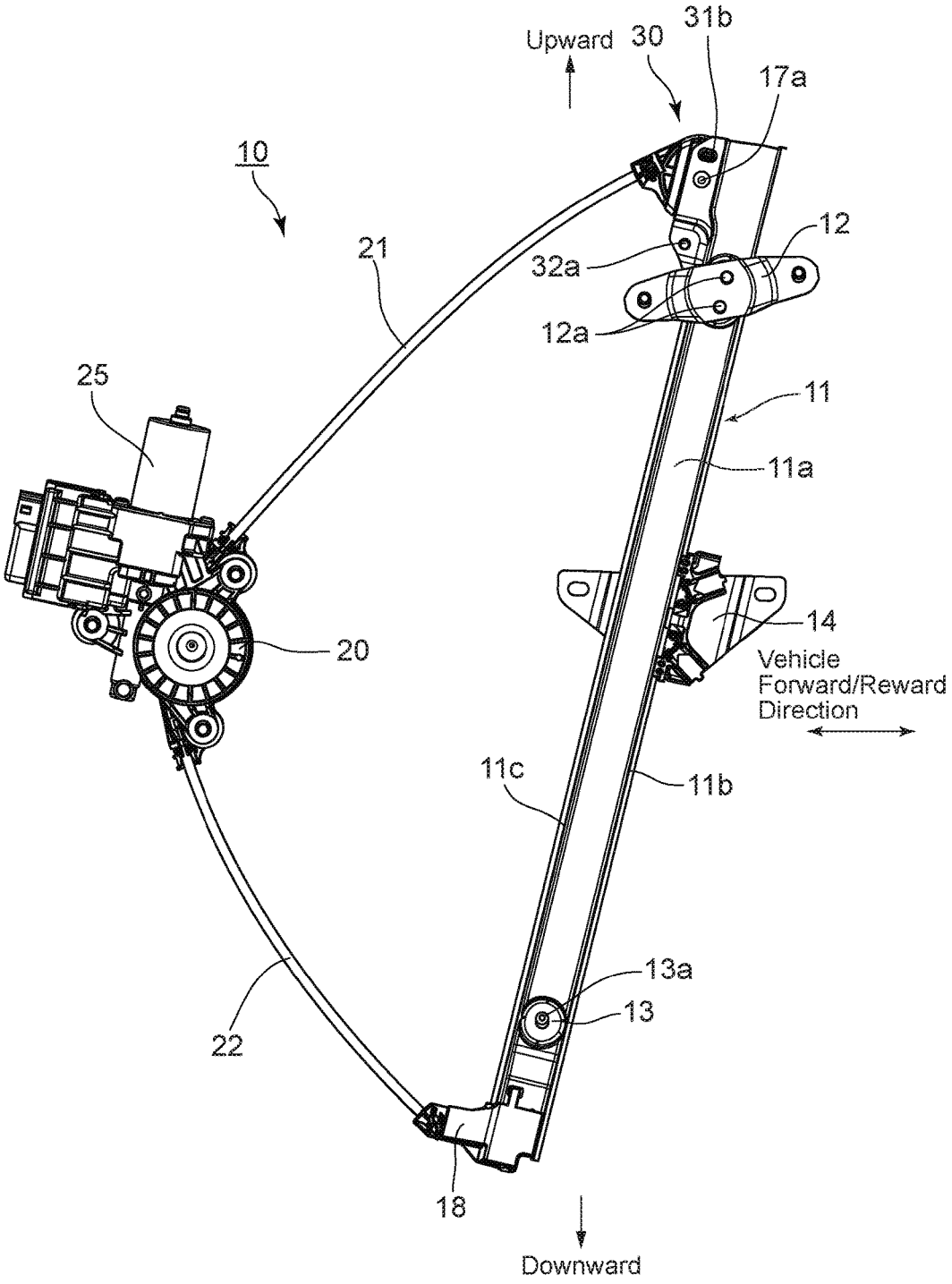
FIG. 1 is a front elevational view of a window regulator, to which the present invention is applied.
Figure 2:
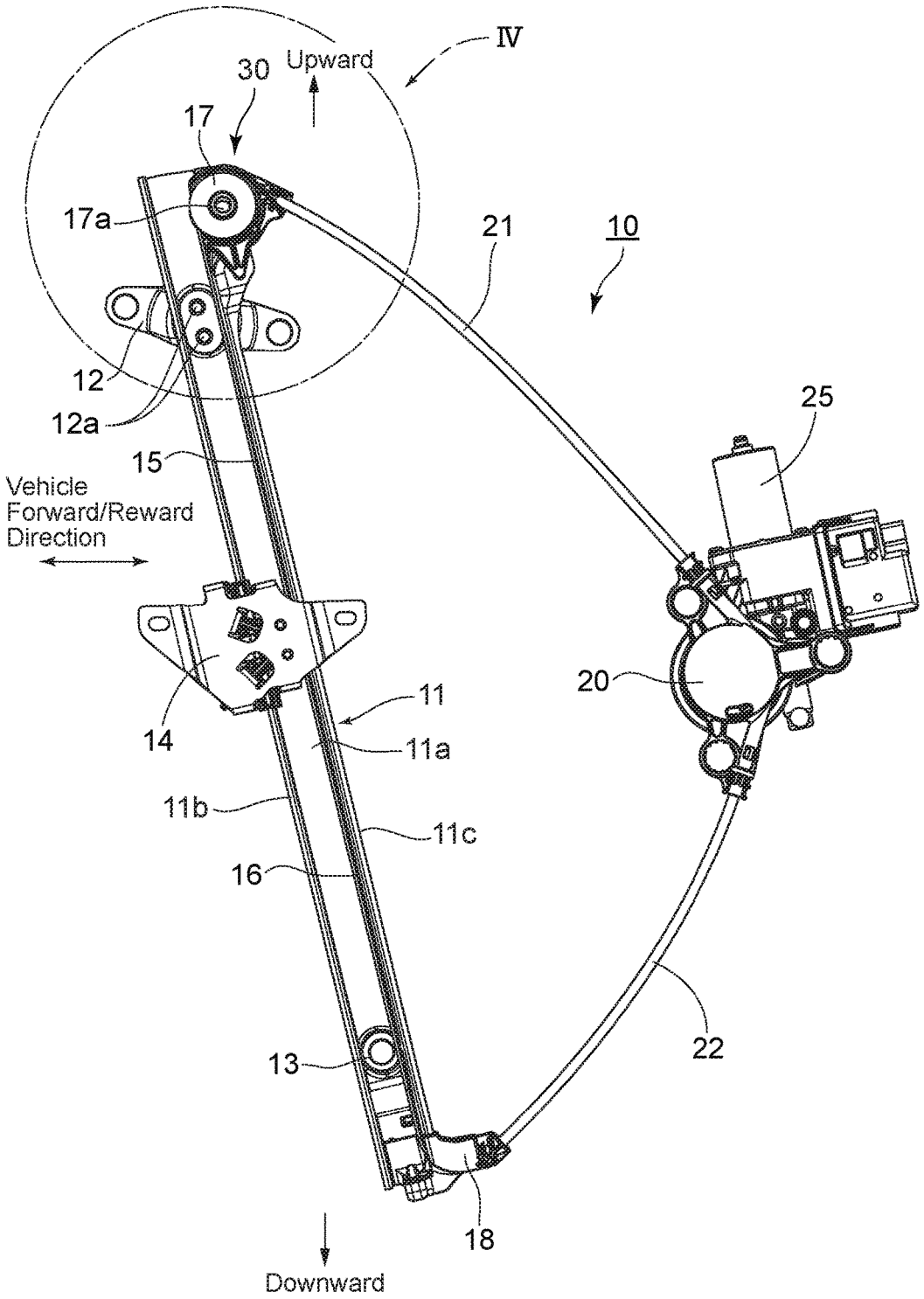
FIG. 2 is a rear elevational view of the window regulator.
Figure 3:
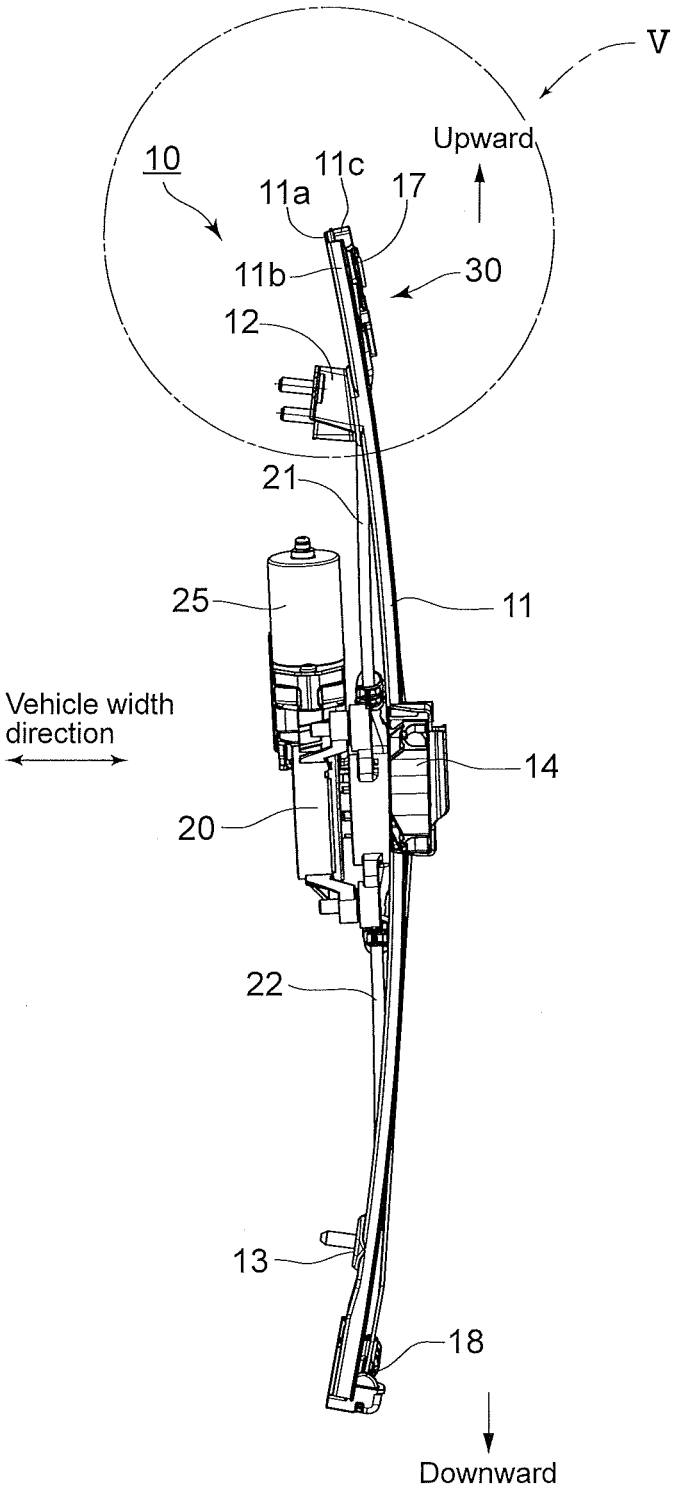
FIG. 3 is side elevational view of the window regulator.
Figure 4:
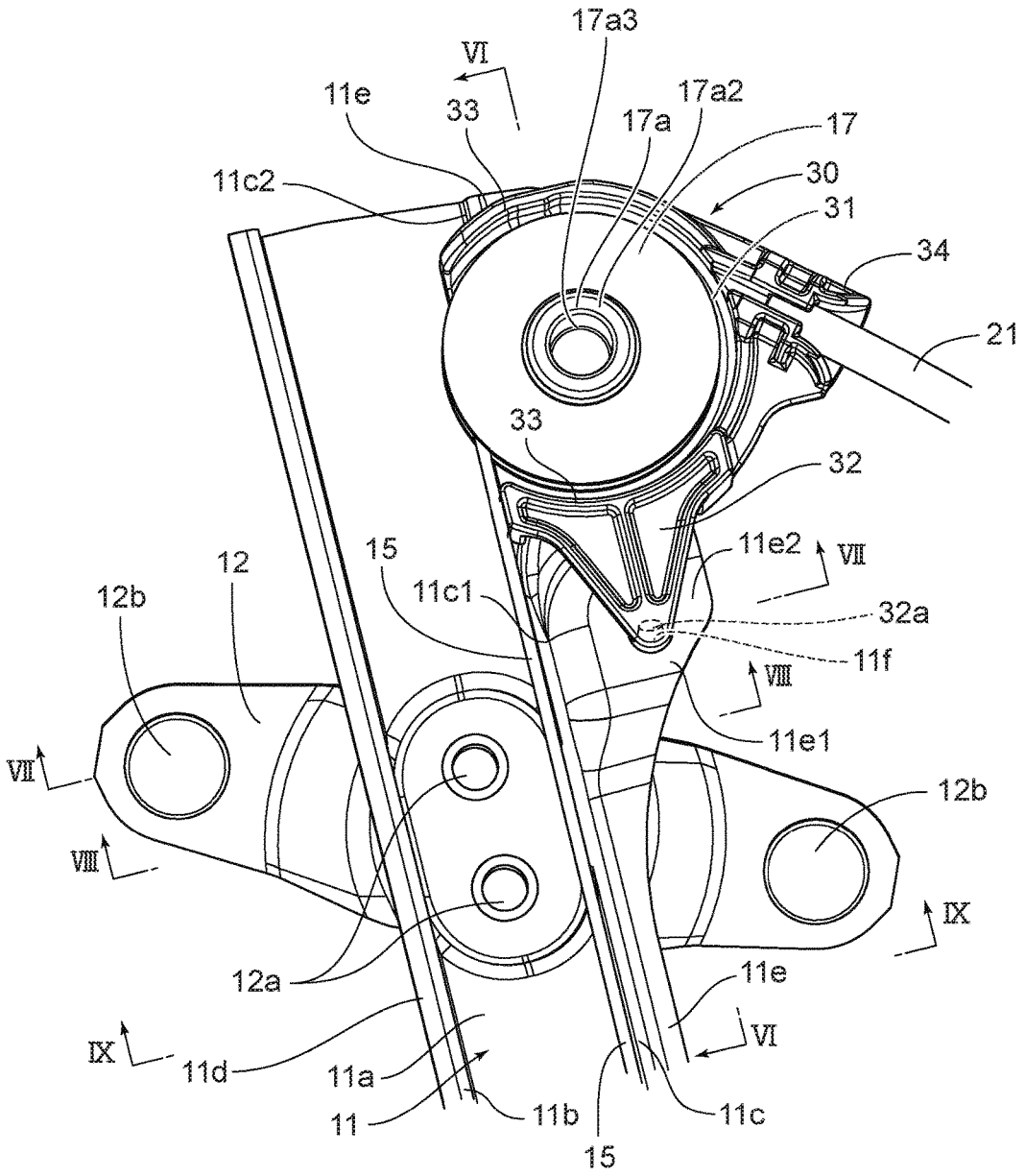
FIG. 4 is an enlarged view of the IV section in FIG. 2.
Figure 5:
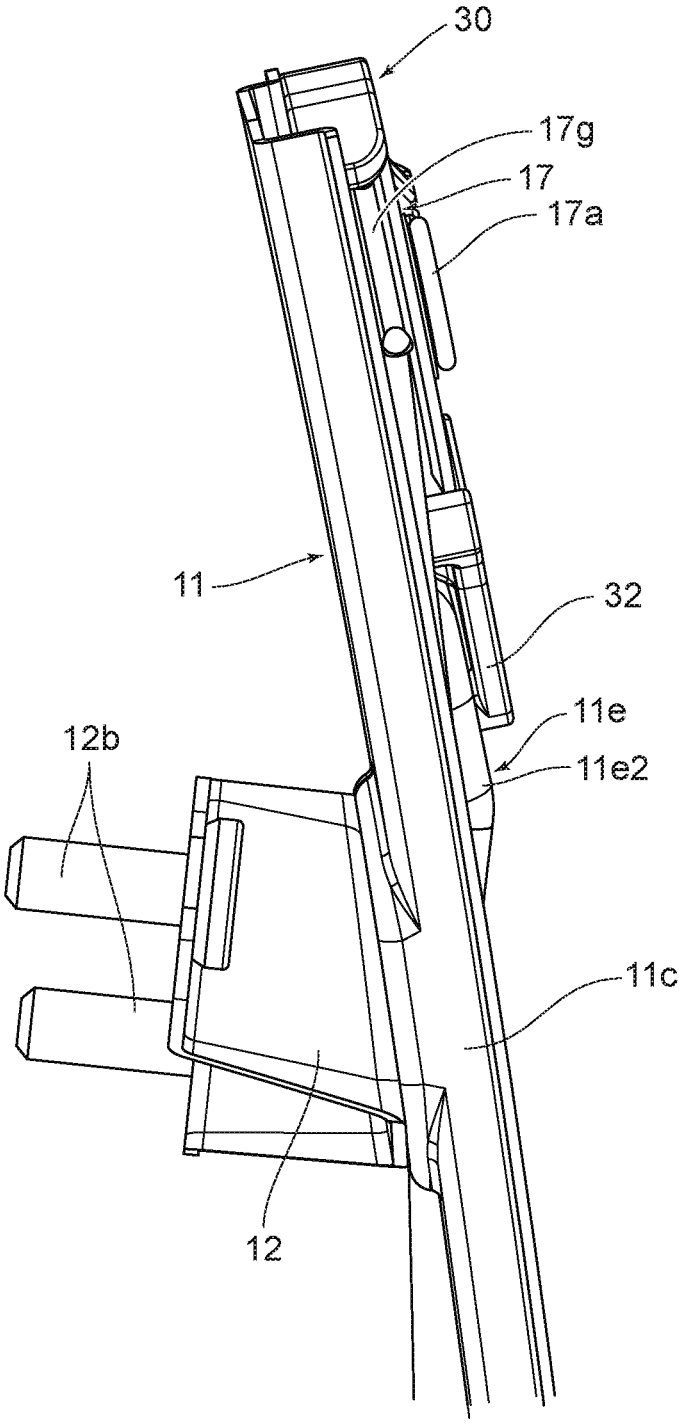
FIG. 5 is an enlarged view of the V section in FIG. 3.

A window regulator 10 shown in FIGS. 1 through 3 raises and lowers a window glass (not shown) that is attached to the inner side of a door panel (not shown) of the vehicle. "Upward" and "Downward" indicated by arrows in FIGS. 1 through 3 correspond to the upward and downward directions of the vehicle.

The window regulator 10 is provided with a guide rail 11, which is an elongated member, and the guide rail 11 is mounted to a door panel (inner panel) via mounting brackets 12 and 13 that are provided at different positions on the guide rail 11 with respect to the longitudinal direction of the guide rail 11. The mounting brackets (panel mounts) 12 and 13 are mounted onto the surface on the vehicle inner side of the guide rail 11 by burred portions 12*a* and 13*a*. A slider base 14, which supports a window glass, is supported to move along the longitudinal direction of the guide rail 11. Respective ends of a pair of drive wires 15 and 16 (FIG. 2) are connected to the slider base 14.

The drive wire 15 extends upwardly along the guide rail 11 from the slider base 14 and is guided by a guide pulley (wire guide) 17, which is provided at the close vicinity of the upper end of the guide rail 11 via a pulley bracket 30. The guide pulley 17 is rotatable about an axle pin (retainer pin) 17*a*, and the guide pulley 17 supports the drive wire 15 via a wire guide groove (winding part) 17*g* (see FIG. 6) formed on an outer peripheral surface thereof. The drive wire 16 extends downwardly along the guide rail 11 from the slider base 14 and is guided by a guide piece 18, which is provided at the close vicinity of the lower end of the guide rail 11. The guide piece 18 is fixed onto the guide rail 11, and the drive wire 16 is supported to advance and retreat along a wire guide groove (not shown) that is formed in the guide piece 18.

The drive wires 15 and 16 that exit from the guide pulley 17 and the guide piece 18 are inserted into guide tubes 21 and 22, and are wound around a wind-up drum (not shown) that is provided inside a drum housing 20, to which the guide tubes 21 and 22 are connected. The drum housing 20 is mounted to the door panel (inner door panel). The wind-up drum is rotatably driven by a drive motor (driver) 25. Upon the wind-up drum being forwardly/rearwardly rotated, one of the drive wires 15 and 16 increases its winding amount onto the wind-up drum (is wound onto the wind-up drum), and the other of the drive wires 15 and 16 is fed out from the wind-up drum, so that the slider base 14 moves along the guide rail 11 in accordance with the pulling and slackening relationship of the pair of drive wires 15 and 16. The window glass is raised and lowered in accordance with the movement of the slider base 14.

FIGS. 4 through 10 show a support structure around the guide pulley 17 at an upper end portion of the guide rail 11. As shown best in FIGS. 4 and 9, the general cross section, excluding the upper and lower end portions, of the guide rail 11 has a top hat cross section, provided with a base wall 11*a*, side walls 11*b* and 11*c*, and collar walls 11*d* and 11*e* which extend in outward directions from free edges of the side walls 11*b* and 11*c*. The side wall 11*b* is substantially orthogonal to the base wall 11*a*, whereas the side wall 11*c* is slightly opened out without being orthogonal to the base wall 11*a*.

Since the side wall 11*c* and the collar wall 11*e* of the guide rail 11 support the guide pulley 17 and the pulley bracket (wire guide) 30, the side wall 11*c* and the collar wall 11*e* have an irregular shape upward from the close vicinity of the mounting bracket 12. Namely, when the height direction is defined as a direction orthogonal to the base wall 11*a*, the side wall 11*c* is provided first with an inclined wall 11*c*1 (FIG. 6) having a smoothly-increasing height from the close vicinity of the mounting bracket 12, a high wall 11*c*2 (FIG. 6), and a pulley lead-in wall 11*c*3 (FIG. 6) which suddenly reduces in height from the high wall 11*c*2.

Figure 6:
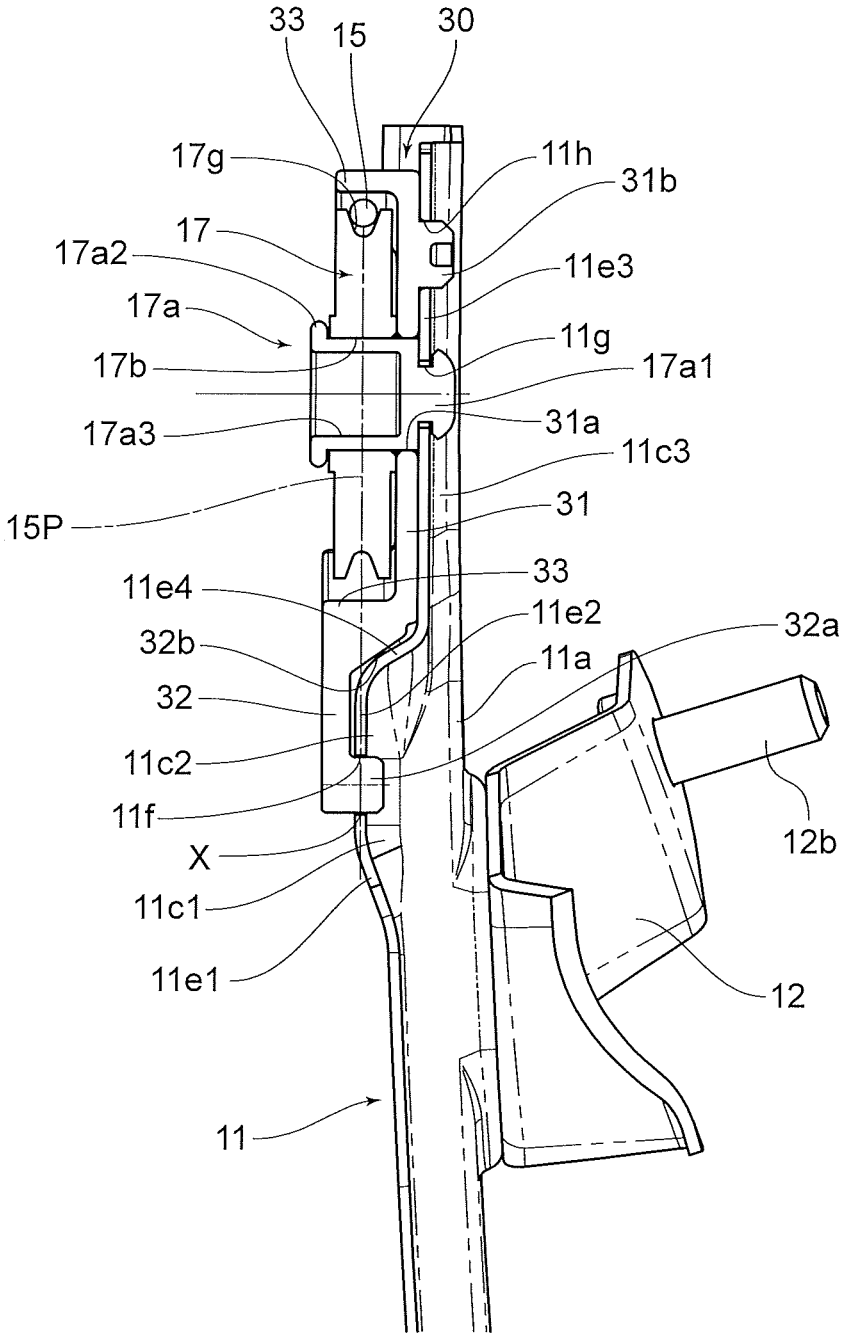
FIG. 6 is cross-sectional view taken along the VI-VI line in FIG. 4.
Figure 10:
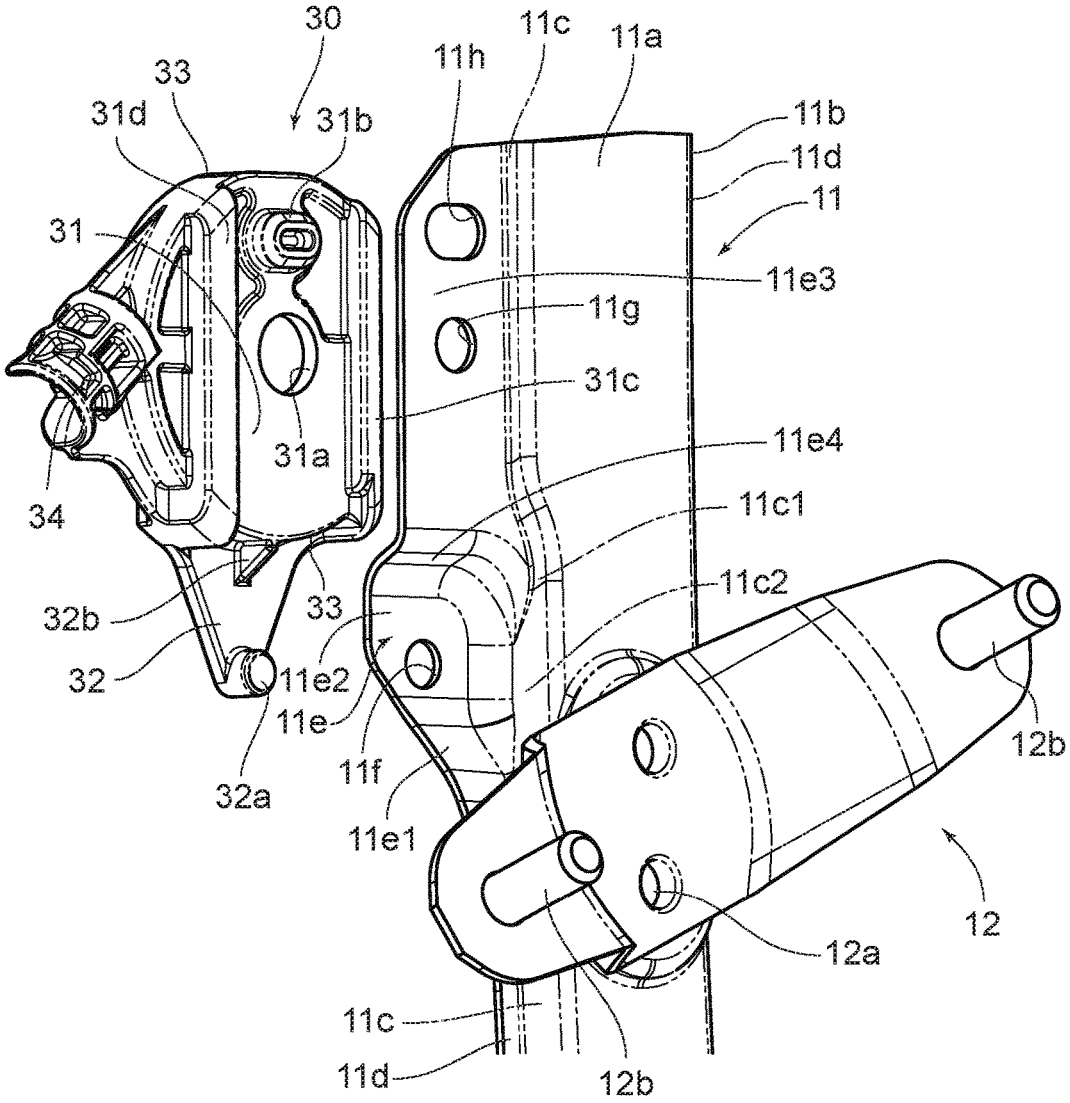
FIG. 10 is an exploded perspective view showing a guide rail and a wire-guide member, to be mounted to the guide rail, in a state before being mounted thereto.

The collar wall 11*e*, which is communicably connected with an upper end (with respect to the height direction) of the inclined wall 11*c*1, is configured of a wide collar wall 11*e*2 via an increasingly-widening collar wall 11*e*1 (FIG. 4 and FIG. 10), which gradually increases in width (the length in the vehicle forward and rearward direction) in an upward direction from the close vicinity of the mounting bracket 12. A lock-engagement hole 11*f* is formed at the vicinity of a boundary between the increasingly-widening collar wall 11*e*1 and the wide collar wall 11*e*2. The vicinity between the increasingly-widening collar wall 11*e*1 and the wide collar wall 11*e*2 is a part of the guide rail 11 that has the largest section coefficients (strengthened section-coefficient portion) with regard to the neutral axis in the vehicle forward and reward direction. Whereas, an upper end of the pulley lead-in wall 11*c*3, with respect to the height direction, is provided with a low collar wall 11*e*3, which is substantially parallel with the base wall 11*a*. The wide collar wall 11*e*2 and the low collar wall 11*e*3 are connected by an inclined wall 11*e*4 (FIG. 6 and FIG. 10). A pulley pin support hole 11*g* and a pulley-bracket support hole 11*h* are formed in the low collar wall 11*e*3.

As shown in the exploded perspective view, from the rear side, in FIG. 10, the pulley bracket 30, which is configured of a molded article of a synthetic resin material, is provided with a guide-pulley support wall 31, which is flat and circular in shape and has a linear cut-out portion at the base wall 11*a* side; a pressing arm (offset supporter/offset extension) 32 extending downwardly from the guide-pulley support wall 31; an eaves portion 33 positioned with respect to an upward and downward direction of the guide pulley 17; and a guide tube supporter 34. As shown in FIGS. 6 and 10, the eaves portion 33 is communicably connected with the pressing arm 32.

A pulley-pin insertion hole 31*a* (FIG. 6) is formed in a central portion of the guide-pulley support wall 31. Amount projection 31*b* (FIGS. 6 and 10), which fits into the pulley-bracket support hole 11*h*, is provided on a surface of the guide-pulley support wall 31 that faces toward the low collar wall 11*e*3. The pressing arm 32 has a substantially tapered triangular shape, in a plan view, and extends in a direction that is substantially parallel to an extending direction of the guide rail 11 from the pulley-pin insertion hole 31*a*. A lock-engaging projection 32*a*, which fits into the lock-engagement hole 11*f*, is formed on the end portion of the pressing arm 32. The engagement portion between the lock-engagement hole 11*f* and the lock-engaging projection 32*a* has a positional relationship so as to overlap with part of the mounting bracket 12, with respect to the upward and downward direction, when viewed in the vehicle forward and rearward direction. Furthermore, an inclined rib 32*b*, which abuts against an inclined wall 11*e*4 of the guide rail 11 is formed on the surface of the pressing arm 32 on the guide rail 11 side.

A plurality of reinforcement ribs 31*c* and 31*d* (FIGS. 7 through 10) are formed on an undersurface (the surface facing the low collar wall 11*e*3 side of the guide rail 11) of the guide-pulley support wall 31 of the pulley bracket 30. The plurality of reinforcement ribs 31*c* and 31*d* extend in an opposite direction to that of the eaves portion 33 from the guide-pulley support wall 31 and extend in the extending direction of the guide rail 11. The reinforcement rib 31*c* abuts against an inner surface of the side wall 11*c* of the guide rail 11, and the reinforcement rib 31*d* extends along the outer edge portion (the edge portion opposite to the side wall 11*c*) of the low collar wall 11*e*3 of the guide rail 11.

The pulley bracket 30 and the guide pulley 17 are supported by the low collar wall 11*e*3 of the guide rail 11 in the following manner. As shown best in FIG. 6, the metal axle pin 17*a* is inserted into an axle hole 17*b* of the guide pulley 17, and an small-diameter end portion 17*a*1 of the axle pin 17*a* is fitted into the pulley pin support hole 11*g* of the low collar wall 11*e*3. Simultaneously, the lock-engaging projection 32*a* of the pressing arm 32 is fitted into the lock-engagement hole 11*f* and the mount projection 31*b* is fitted into the pulley-bracket support hole 11*h*. The axle pin 17*a* is provided with a flange 17*a*2 on the opposite end of the axle pin 17*a* to the small-diameter end portion 17*a*1, and a bottomed hole 17*a*3 is formed into the axle portion of the axle pin 17*a*. The axle pin 17*a* is mounted onto the low collar wall 11*e*3, by clinching the head of the small-diameter end portion 17*a*1 in a state where a clinching jig is inserted into the bottomed hole 17*a*3, so that the guide pulley 17 is rotatably supported between the flange 17*a*2 of the axle pin 17*a* and the guide-pulley support wall 31 (and the small-diameter end portion 17*a*1 and the low collar wall 11*e*3), and the pulley bracket 30 is mounted onto the low collar wall 11*e*3. The mount projection 31*b* is thermobonded in a state where the mount projection 31*b* is fitted into the pulley-bracket support hole 11*h*. This mount projection 31*b* is also a mounting portion for mounting the pulley bracket 30 to the guide rail 11. The drive wire 15 is wound around the wind-up drum, provided inside the drum housing 20, after being wound onto the wire guide groove 17*g* on the peripheral surface of the guide pulley 17.

The above-described pulley bracket 30 is mounted to the low collar wall 11*e*3 (guide rail 11) at two positions, at the axle pin 17*a* and at the mount projection 31*b* (pulley-bracket support hole 11*h*). In this state, due to the lock-engaging projection 32*a* of the pressing arm 32 engaging with the lock-engagement hole 11*f* of the guide rail 11 (wide collar wall 11*e*2), deformation of the guide rail 11 when a downward tension is applied on the guide pulley 17 via the drive wire 15 can be suppressed. Since the mounting bracket 12 is mounted to the door panel via a mounting bolt 12*b*, this gives no opportunity for bowing deformation to occur, downward from the mounting bracket 12, in the guide rail 11; and since the engaging portion between the lock-engagement hole 11*f* of the guide rail 11 and the lock-engaging projection 32*a* of the pressing arm 32 has a positional relationship so as to overlap with part of the mounting bracket 12, with respect to the upward and downward direction, when viewed in the vehicle forward and rearward direction, the possibility of bowing deformation occurring in the guide rail 11 is further decreased. Furthermore, due to the inclined rib 32*b* abutting against the inclined wall 11*e*4, the combined section coefficients, with regard to the neutral axis in the vehicle forward and reward direction, of the guide rail 11 and the pulley bracket 30 increase, thereby suppressing deformation of the guide rail 11. Furthermore, the reinforcement ribs 31*c* and 31*d* which are formed on the underside of the guide-pulley support wall 31 also, and the same manner, suppress (bowing) deformation of the pulley bracket 30 itself and the bowing deformation of the guide rail 11.

Figure 7:
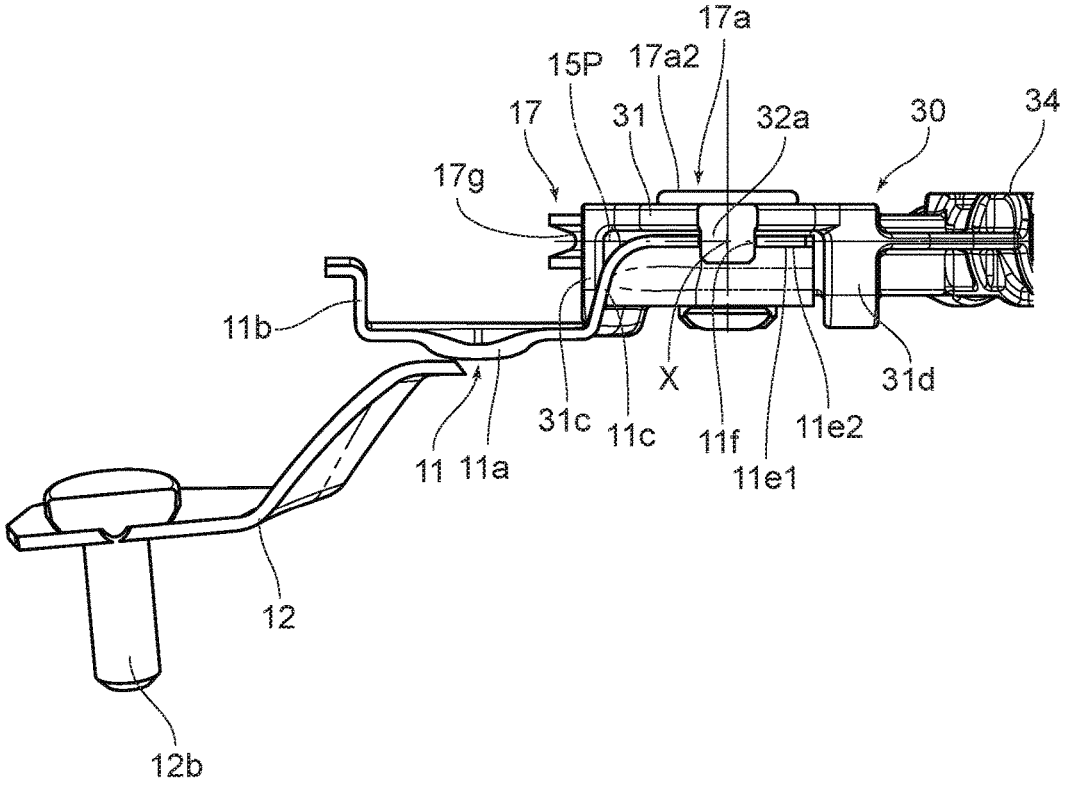
FIG. 7 is a cross-sectional view taken along the VII-VII line in FIG. 4.
Figure 8:
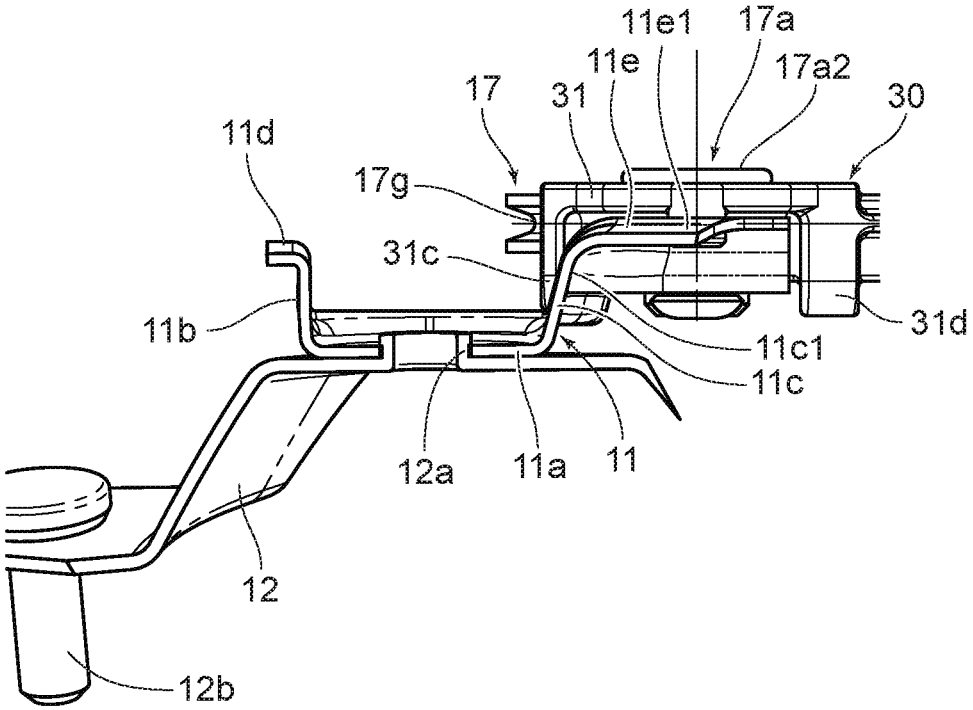
FIG. 8 is a cross-sectional view taken along the VIII-VIII line in FIG. 4.
Figure 9:
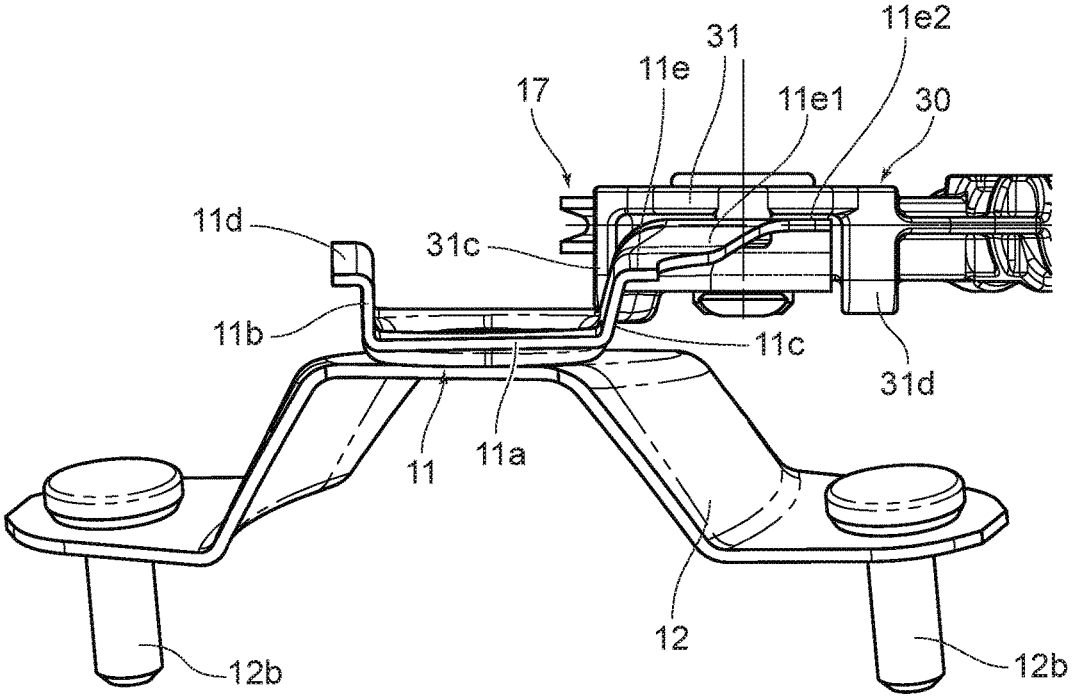
FIG. 9 is a cross-sectional view taken along the IX-IX line in FIG. 4.
Figure 11:
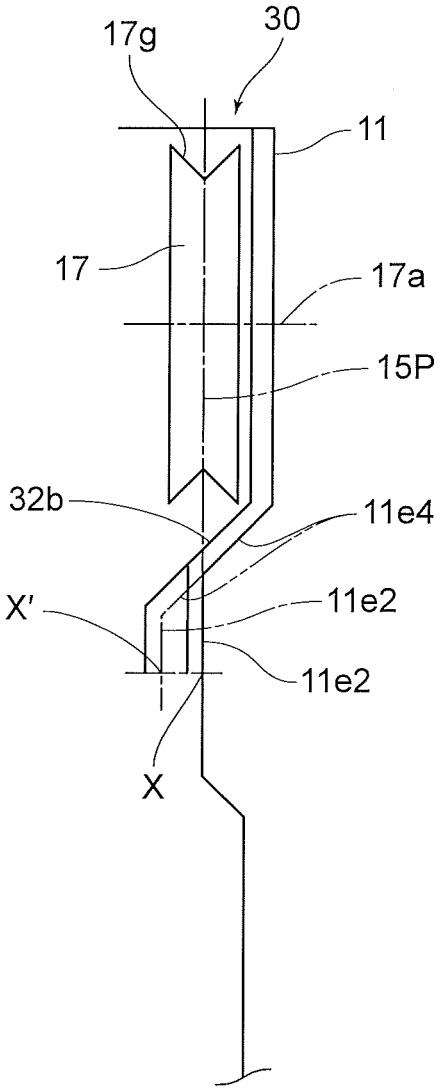
FIG. 11 is a skeleton explanatory view showing the relationship between the wire-guide member, mounted onto the guide rail, and a pressing arm (pressing member) of the wire-guide member.

The deformation prevention effects of the guide rail 11 due to the engagement between the lock-engaging projection 32*a* and the lock-engagement hole 11*f* will be hereinafter explained. As shown in FIGS. 6 and 7, in the present embodiment, the engaging portion (pressing portion) X between the lock-engagement hole 11*f* and the lock-engaging projection 32*a* is located at an edge side of the guide rail 11 at which the guide pulley 17 is not present and is positioned on a plane 15P that includes the drive wire 15 that is wound onto the wire guide groove 17*g* of the guide pulley 17. In other words, the engaging portion (pressing portion) X between the lock-engagement hole 11*f* and the lock-engaging projection 32*a* is formed at a position that is offset, from the pulley pin support hole 11*g* and the pulley-bracket support hole 11*h*, in a vehicle width direction toward the wire guide groove (winding part) 17*g*. Accordingly, even if the guide pulley 17 is pulled downwardly by tension applied on the drive wire 15, such force simply acts as a compression force in the upward and downward direction of (the wide collar wall 11*e*2 of) the guide rail 11, and does not cause bowing deformation. FIG. 11 is a skeleton view showing the positional relationship between the engagement portion X, of the lock-engaging projection 32*a* and the lock-engagement hole 11*f*, and the plane 15P including the drive wire 15. If an engaging portion X', between the lock-engaging projection 32*a* and the lock-engagement hole 11*f*, is positioned (offset) from the plane 15P (including the drive wire 15) away from the mounting bracket 12, a force in an opposite direction of bowing deformation acts on (the wide collar wall 11*e*2 of) the guide rail 11, so that bowing deformation does not occur.

Figure 12:
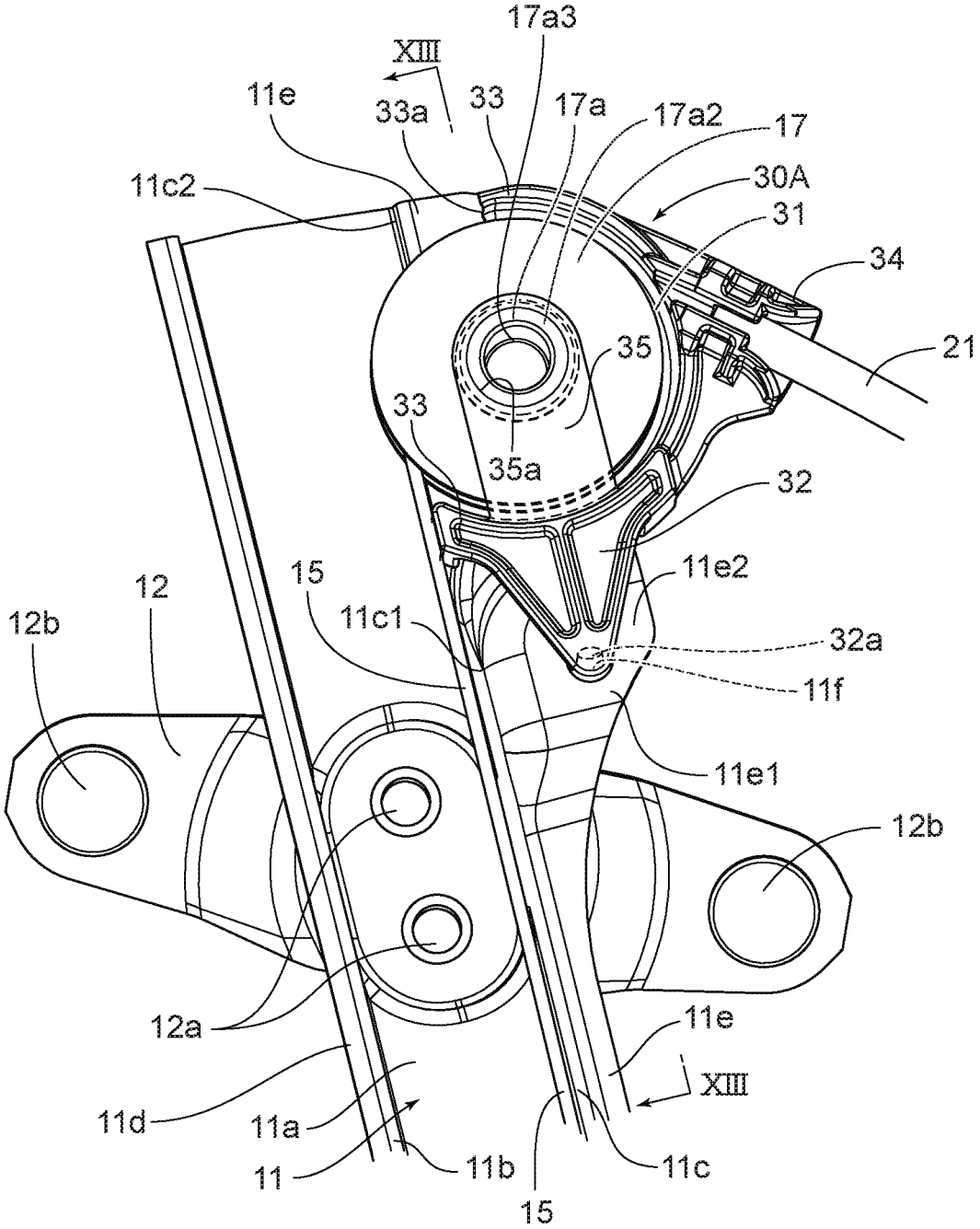
FIG. 12 corresponds to FIG. 4 and shows another embodiment of a window regulator pertaining to the present invention.
Figure 13:
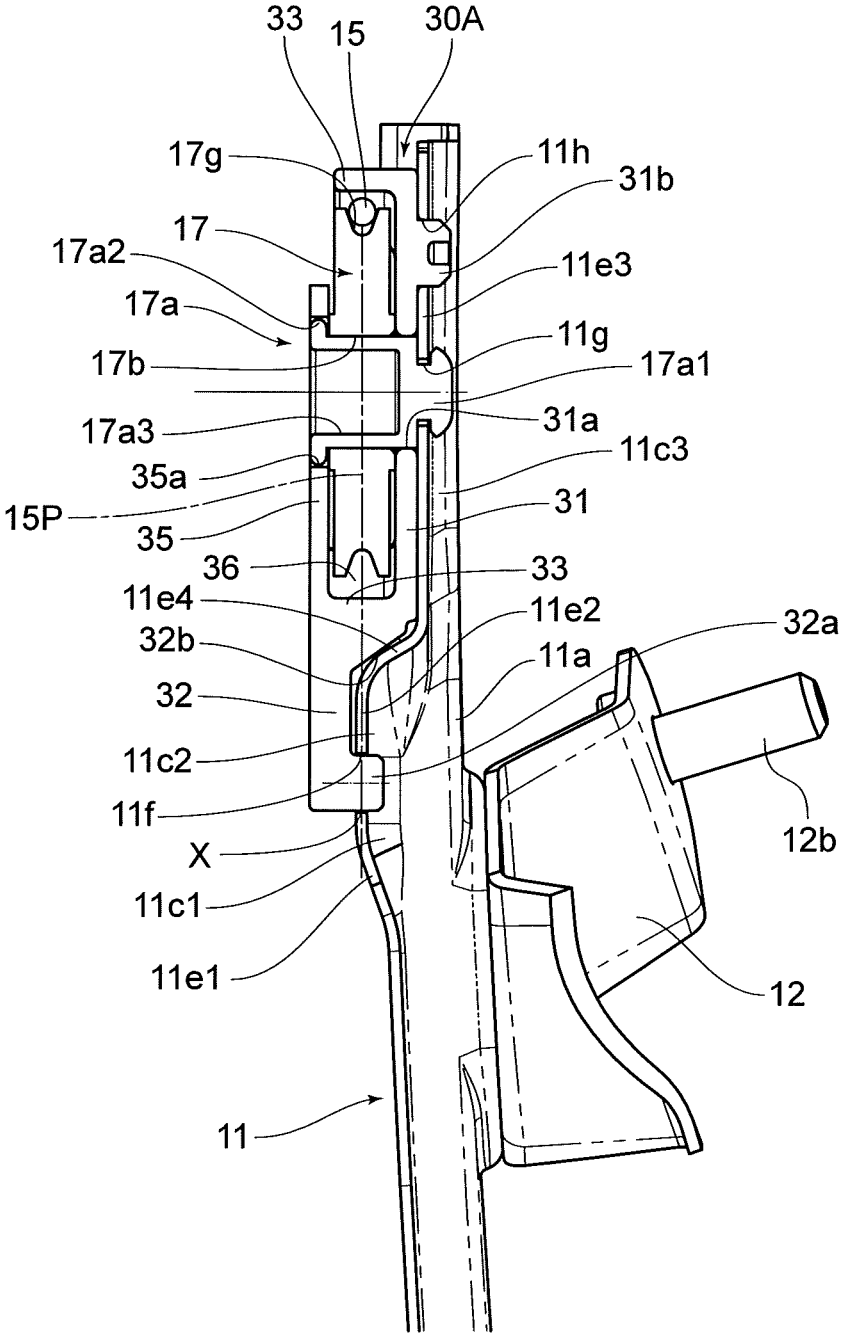
FIG. 13 is cross-sectional view taken along the XIII-XIII line in FIG. 12.

FIG. 12 and FIG. 13 show another embodiment of the window regulator, according to the present invention. FIG. 12 corresponds to FIG. 4, and FIG. 13 corresponds to FIG. 6. This embodiment is a modification of the shape of the pulley bracket 30A in which, in addition to the pulley bracket 30 of the above embodiment, a pulley-axle supporter (support wall) 35, which is integral with the pressing arm 32 and extends from downward to upward directions in FIGS. 12 and 13, is provided. The pulley-axle supporter 35 is parallel with the guide-pulley support wall 31 and forms an insertion space 36, for the guide pulley 17, between the pulley-axle supporter 35 and the guide-pulley support wall 31. An insertion support hole 35*a* for the axle pin 17*a* is formed in the end portion (the upper end in the drawing) of the pulley-axle supporter 35.

On the other hand, the pulley bracket 30A of this embodiment differs from the pulley bracket 30 of the above-described embodiment with respect to an eaves-cutout section 33*a* (FIG. 12), which is formed as a partial cutout from the eaves portion 33. The guide pulley 17 can be inserted into the insertion space 36 from the eaves-cutout section 33*a*. The other configurations of this embodiment are the same as the previous embodiment, and the same parts are designated by the same numerals.

In this embodiment, upon the axle pin 17*a* being inserted into the axle hole 17*b* of the guide pulley 17 (which is inserted into the insertion space 36 of the pulley bracket 30A) and the insertion support hole 35*a* of the pulley-axle supporter 35, the small-diameter end portion 17*a*1 being fitted into the pulley-pin insertion hole 31*a* and being fixedly clinched at the pulley pin support hole 11*g* of the guide rail 11, the flange 17*a*2 is fit-engaged into the insertion support hole 35*a* so that both ends of the axle pin 17*a* are supported by the pulley bracket 30A. Accordingly, the force applied on the guide pulley 17 via the drive wire 15 can be efficiently transferred to the guide rail 11 via the pressing arm 32.

The above descriptions are of embodiments in which the pulley bracket 30 having the guide pulley 17 is configured as a wire guide; however, the present invention can also be applied to a wire guide member (e.g., such as the guide piece 18 shown in FIGS. 1 and 2) that is not provided with a guide pulley.

The pressing arm 32 of the above embodiment has a substantially tapered triangular shape, in a plan view, and one lock-engaging projection 32*a* that fits into the lock-engagement hole 11*f* is formed on the end portion of the pressing arm 32; however, the pressing arm can be formed in a substantially rectangular shape. In such an embodiment, a pair of lock-engaging projections 32*a* may be provided at either corner of the rectangular pressing arm.

INDUSTRIAL APPLICABILITY

The window regulator according to the present invention can be applied to vehicles in general, which have a window glass that is raised and lowered.

REFERENCE SIGNS LIST

10 Window regulator
11 Guide rail
11*a* Base wall
11*b*, 11*c* Side walls
11*c*1 Inclined wall
11*c*2 High wall
11*c*3 Pulley lead-in wall
11*d*, 11*e* Collar walls
11*e* Collar wall
11*e*1 Increasingly-widening collar wall
11*e*2 Wide collar wall
11*e*3 Low collar wall
11*e*4 Inclined wall
11*f* Lock-engagement hole
11*g* Pulley pin support hole
11*h* Pulley-bracket support hole
12, 13 Mounting brackets (panel mounts)
12*a* Burred portion
12*b* Mounting bolt
14 Slider base
15, 16 drive wire
15P plane including drive wire
17 Guide pulley (pulley/wire guide)
17*a* Axle pin (retainer/pulley axle/retainer pin)
17*a*1 Small-diameter end portion
17*a*2 Flange
17*a*3 Bottomed hole
17*b* Axle hole
17*g* Wire guide groove (winding part)
21, 22 Guide tube
25 Drive motor (driver)
30, 30A Pulley bracket (wire guide)
31 Guide-pulley support wall
31*a* Pulley-pin insertion hole
31*b* Mount projection (retainer)
31*c*, 31*d* Reinforcement ribs
32 Pressing arm
32*a* Lock-engaging projection (pressing portion/projection)
32*b* Inclined rib
33 Eaves portion
33*a* Eaves-cutout section
34 Guide tube supporter
35 Pulley-axle supporter (support wall)
35*a* Insertion support hole
36 Insertion space
X Engaging portion (pressing portion)

The invention claimed is:

1. A window regulator for a vehicle comprising:
a guide rail extending in an upward and downward direction;
a slider base supported on the guide rail in a manner to be raisable and lowerable therealong, a window glass being mounted onto the slider base;
a drive wire connected to the slider base;
a wire guide supported at one end of the guide rail, the wire guide having a winding part onto which the drive wire is wound at a position offset from the guide rail in a vehicle width direction; and
a driver configured to raise and lower the slider base via the drive wire,
wherein the wire guide is supported by the guide rail by at least a retainer and a pressing portion, the retainer being engaged with the guide rail to prevent the wire guide from moving away from the guide rail in the vehicle width direction, and the pressing portion being engaged with the guide rail so as to press a portion of the guide rail which is engaged by the pressing portion toward an other end of the guide rail, and
wherein the pressing portion is formed at a position which is closer to the other end of the guide rail relative to the retainer, and the portion of the guide rail which is engaged by the pressing portion is offset from a portion of the guide rail which is engaged by the retainer in the vehicle width direction toward the winding part.

2. The window regulator for a vehicle according to claim 1, wherein 1) the pressing portion is positioned on a plane of movement in which the drive wire runs in accordance with the wire guide, or 2) the pressing portion is positioned off the plane away from the retainer.

3. The window regulator for a vehicle according to claim 1, wherein the pressing portion overlaps with part of a panel mount, with respect to the upward and downward direction, when viewed in a vehicle forward and rearward direction, the panel mount configured to mount the guide rail to a door panel.

4. The window regulator for a vehicle according to claim 1, wherein the wire guide comprises:
a pulley bracket; and
a pulley, onto which the drive wire is wound, the pulley being rotatably supported by the pulley bracket, wherein the retainer includes a pulley axle which supports the pulley and the pulley bracket onto the guide rail, and wherein the pressing portion is formed on the pulley bracket.

5. The window regulator for a vehicle according to claim 4, wherein the pressing portion is connected to the pulley bracket, wherein the pulley bracket includes a pulley-axle supporter with which the pulley axle engages, wherein the pulley-axle supporter and the retainer are positioned to sandwich the pulley, in the vehicle width direction, and wherein the pulley axle presses the pulley-axle supporter toward said other end of the guide rail.

6. The window regulator for a vehicle according to claim 1, wherein the pressing portion comprises a projection which engages with a hole of the guide rail.

* * * * *